US012723486B2

(12) United States Patent
Brummert

(10) Patent No.: US 12,723,486 B2
(45) Date of Patent: Sep. 1, 2026

(54) DOWNHOLE TOOL HAVING A FLUID RESERVOIR AND METHODS THEREOF

(71) Applicant: Brummert Applied Sciences, LLC, Midland, TX (US)

(72) Inventor: Damien James Brummert, Midland, TX (US)

(73) Assignee: Brummert Applied Sciences, LLC, Midland, TX (US)

( * ) Notice: Subject to any disclaimer, the term of this patent is extended or adjusted under 35 U.S.C. 154(b) by 0 days.

(21) Appl. No.: 19/157,003

(22) PCT Filed: Feb. 20, 2024

(86) PCT No.: PCT/US2024/016442

§ 371 (c)(1),
(2) Date: Aug. 15, 2025

(87) PCT Pub. No.: WO2024/173930

PCT Pub. Date: Aug. 22, 2024

(65) Prior Publication Data

US 2026/0117615 A1 Apr. 30, 2026

Related U.S. Application Data

(60) Provisional application No. 63/485,892, filed on Feb. 18, 2023.

(51) Int. Cl.
*E21B 33/129* (2006.01)
*E21B 23/06* (2006.01)
(Continued)

(52) U.S. Cl.
CPC ..... *E21B 33/1293* (2013.01); *E21B 23/06* (2013.01); *E21B 31/00* (2013.01); *E21B 33/128* (2013.01); *E21B 33/134* (2013.01)

(58) Field of Classification Search
CPC ... E21B 33/1293; E21B 33/128; E21B 33/134
See application file for complete search history.

(56) References Cited

U.S. PATENT DOCUMENTS 2,696,258 A * 12/1954 Greene ..... E21B 33/134 166/187
3,223,170 A * 12/1965 Mott ..... E21B 33/16 166/212

(Continued)

FOREIGN PATENT DOCUMENTS

WO 2021236414 A1 11/2025

OTHER PUBLICATIONS

Matos, Taina; International Search Report and Written Opinion of the International Searching Authority; Int'l. App. No. PCT/US2024/016442; May 13, 2024; 15 pages.

*Primary Examiner* — Shane Bomar
(74) *Attorney, Agent, or Firm* — FBT GIBBONS LLP

(57) ABSTRACT

A downhole tool includes a mandrel, a slip, a sealing element, and a fluid reservoir. The slip is configured to selectively extend radially outwardly from the mandrel to facilitate engagement with a wellbore for setting of the downhole tool thereto. The sealing element is configured to selectively extend radially outwardly from the mandrel to facilitate engagement with a wellbore for creating a seal therebetween. The fluid reservoir is configured to store a fluid onboard the downhole tool.

20 Claims, 2 Drawing Sheets

(51) Int. Cl.

| | |
|---|---|
| ***E21B 31/00*** | (2006.01) |
| ***E21B 33/128*** | (2006.01) |
| ***E21B 33/134*** | (2006.01) |

(56) References Cited

U.S. PATENT DOCUMENTS

| | | | | |
|---|---|---|---|---|
| 3,374,838 | A | 3/1968 | Current | |
| 4,051,896 | A * | 10/1977 | Amancharla | E21B 23/06 166/123 |
| 8,839,855 | B1 * | 9/2014 | McClinton | E21B 34/14 166/135 |
| 2014/0224506 | A1 * | 8/2014 | Xu | E21B 33/129 166/376 |
| 2015/0013965 | A1 | 1/2015 | Cox et al. | |
| 2019/0169954 | A1 * | 6/2019 | Cabot | E21B 23/08 |
| 2021/0062597 | A1 * | 3/2021 | Yuan | E21B 21/10 |
| 2021/0140255 | A1 | 5/2021 | Greci et al. | |
| 2022/0136358 | A1 * | 5/2022 | Mitchell | E21B 33/1216 166/387 |
| 2022/0145726 | A1 * | 5/2022 | Head | E21B 33/134 |
| 2022/0228458 | A1 * | 7/2022 | Jaaskelainen | E21B 33/1208 |
| 2023/0349253 | A1 * | 11/2023 | Zakharia | E21B 33/134 |

* cited by examiner

DOWNHOLE TOOL HAVING A FLUID RESERVOIR AND METHODS THEREOF

REFERENCE TO RELATED APPLICATION

This application claims priority of U.S. Pat. App. No. 63/485,892, entitled "Utilizing Suitably Designed/Manufactured Mechanical Wellbore Isolation Tools as the Vehicle for Delivery and/or Deployment Method for Tubular Metal-On-Metal Lubricants (and/or Any Other Material Being Delivered/Deployed in This Manner) Within a Wellbore," filed Feb. 18, 2023, the disclosure of which is incorporated by reference herein in its entirety.

TECHNICAL FIELD

The apparatus described below generally relates to a downhole tool for use in hydraulic fracking. In particular, the downhole tool includes a fluid reservoir that stores fluid onboard the downhole tool for introduction into a wellbore during removal of the downhole tool from the wellbore.

BACKGROUND

Hydraulic fracturing, commonly known as "fracking," is a technique used to extract hydrocarbons (e.g., oil and gas) from underground geologic formations. Fracking involves pumping a fluid at high pressure down a well to create fractures in the hydrocarbon-bearing rock, allowing oil and gas to flow more freely into the wellbore.

A component of the fracking process is the use of downhole tools known as "frac plugs." Frac plugs are placed inside the wellbore to isolate specific sections of the well during fracking. A typical fracking operation proceeds in stages, with frac plugs being set between stages to control where fracking fluids are introduced along the well.

Common types of frac plugs include composite and cast-iron bridge plugs, frac balls, and composite frac plugs. Bridge plugs utilize slips, cones, and rubber sealing elements to seal off sections of casing. Frac balls, as the name implies, are ball-shaped plugs that seat into tailored landing locations. Composite plugs are made of tough, molded composite material able to withstand high differential pressures.

The frac plug allows for a section of the well to be pressurized without the fracturing fluid escaping into sections above or below that stage. Once fracking operations are complete in a stage isolated by a frac plug, the set plug must be drilled out or milled away to regain continuous well access. Milling is typically done using a rotating bit or milling tool sized to grind up the plug components. Lubricants are often pumped during milling to prevent excessive torque or sticking of the mill against metal scrap in the well.

Lubricant additives reduce friction between the mill and the frac plug debris being generated. By lubricating this interface, potential damage to the milling tool and workstring tubular is minimized. Additionally, lubrication helps prevent stuck pipe situations arising from excessive torque caused by milling out plug components. Most frac plugs are designed to be drilled out rather easily. Removing the plug allows the fractures from the multiple stages to intersect, improving permeability.

BRIEF DESCRIPTION OF THE DRAWINGS

Various embodiments will become better understood with regard to the following description, appended claims and accompanying drawings wherein:

DETAILED DESCRIPTION

Figure 1:
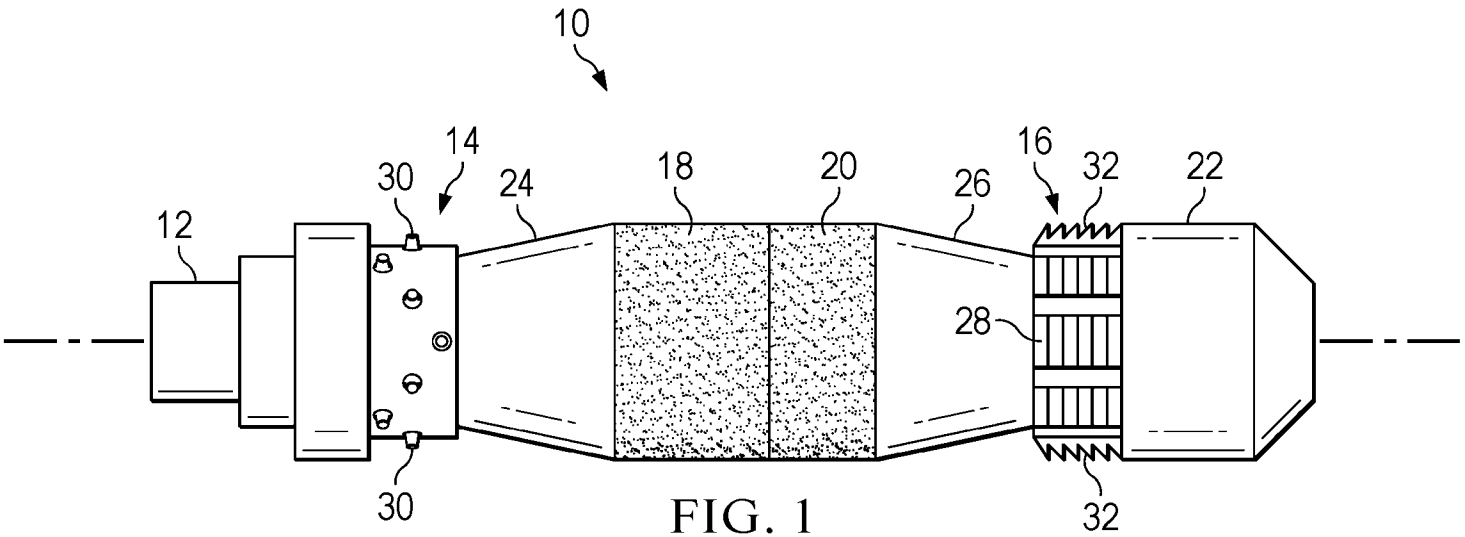
FIG. 1 (PRIOR ART)
FIG. 1 is a side view depicting a conventional bridge plug.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Described herein are example embodiments of a downhole tool used to isolate sections of a hydrocarbon wellbore in preparation for hydraulic fracturing ("fracking"). The downhole tool can be associated with a setting mechanism or workstring that facilitates setting of the downhole tool in a wellbore. In the illustrated embodiments, the downhole tool is disclosed as including at least one onboard fluid reservoir that contains a lubricant or other fluid that allows for dispensation of lubrication directly to targeted areas at various stages of the wellbore as the removal tool progresses into the wellbore. It is to be understood that the disclosure is not to be limited only to the downhole tools and features thereof illustrated herein.

FIG. 1 illustrates a conventional bridge plug 10 (hereinafter "bridge plug 10") which is shown to include a mandrel 12, an upper slip 14, a lower slip 16, an upper sealing element 18 and a lower sealing element 20 disposed between the upper and lower slips 14, 16. A nosecone 22 can be disposed at a distal end of the lower slip 16.

The upper and lower slips 14, 16 can be configured to slide towards each other and along an upper slip ramp 24 and a lower slip ramp 26, respectively. When the upper and lower slips 14, 16 are slid towards each other, the conical shape of the upper and lower slip ramps 24, 26 can bear against respective inner surfaces of the upper and lower slips 14, 16 to cause them to expand radially outwardly and into engagement with a wellbore to facilitate setting of the bridge plug 10 within the wellbore. The upper and lower slips 14, 16 can each include wedge shaped segments (e.g., 28) that can expand relative to, or even separate from, each other during radial expansion of the upper and lower slips 14, 16 to encourage engagement with the wellbore. The upper and lower slips 14, 16 can include teeth 30, 32 that are configured to embed into, or otherwise physically interface with, the wellbore to facilitate securement of the bridge plug 10 thereto. The upper and lower slips 14, 16 can additionally or alternatively include any of a variety of other suitable features that facilitate engagement with the wellbore, such as, for example, an outer surface impregnated with a hardened grit.

The upper and lower sealing elements 18, 20 can be configured to extend radially outwardly when they are axially compressed together. As such, once the upper and lower slips 14, 16 are engaged with the wellbore, the upper and lower sealing elements 18, 20 can be axially compressed to extend them radially into engagement with the wellbore to provide an effective fluid seal therebetween that prevents fluid from migrating across the bridge plug 10. The upper and lower sealing elements 18, 20 can be formed of an elastomeric material, such as molded nitrile rubber, or any of a variety of other suitable additional or alternative materials that are flexible and configured to form an effective seal with a wellbore.

The bridge plug 10 can include a compression mechanism (not shown) that is configured to selectively apply axial compression to each of the upper and lower slips 14, 16 and the upper and lower sealing elements 18, 20 to cause radial expansion thereof. The compression mechanism can be disposed within an interior of the mandrel 12 but can also be positioned at other locations along the mandrel 12. The compression mechanism can be a mechanical screw assembly, a hydraulically actuated piston, explosively set power springs, or any of a variety of other suitable devices or combinations thereof. When the bridge plug 10 is located in a wellbore, the compression mechanism, and thus the upper and lower slips 14, 16 and the upper and lower sealing elements 18, 20, can be remotely activated from above ground. A compressor actuator can be activated via an actuator that is routed through the wellbore. The compressor actuator can be a mechanical actuator, hydraulic actuator, or an electrical actuator depending on the type of compressor actuator that is being used (i.e., a mechanical screw assembly, a hydraulically actuated piston, or explosively set power springs, respectively).

A conveyance tubular (not shown) can be attached to the mandrel 12 of the bridge plug 10 and can serve as the conveyance vehicle for delivering and positioning the bridge plug 10 within the wellbore. The conveyance tubular can also house the actuator to allow the actuator to extend between the ground surface and the bridge plug 10 when the bridge plug 10 is positioned in the wellbore. Typical conveyance tubulars can include jointed pipe, coiled tubing, or purpose-built plug setting tools.

To facilitate installation of the bridge plug 10 in the wellbore, the conveyance tubular and the bridge plug 10 can be attached together while both are above ground. The bridge plug 10 can then be inserted into the wellbore and guided towards its desired position via the conveyance tubular. Once the bridge plug 10 reaches its desired location, the compressor actuator can be activated via the actuator to set the position of the bridge plug 10 with the upper and lower slips 14, 16 as well as to seal off the wellbore with upper and lower sealing elements 18, 20. After the bridge plug 10 is properly set and sealed, the conveyance tubular can be disconnected from the bridge plug 10 and withdrawn from the wellbore to allow for fracking of the area above the bridge plug 10 to commence. Once the fracking of the wellbore has been completed, the bridge plug 10 can be removed by either drilling or milling the bridge plug 10 from the wellbore with a removal tool (e.g., a rotary drill bit or milling bit). Such removal oftentimes requires that a lubricant or other solution be pumped through the wellbore to the bridge plug 10 which can be expensive, time consuming and, depending on the depth of the bridge plug 10, can be subject to severe dilution of the lubricant which can render it ineffective, thus preventing proper removal of the bridge plug 10.

Figure 2:
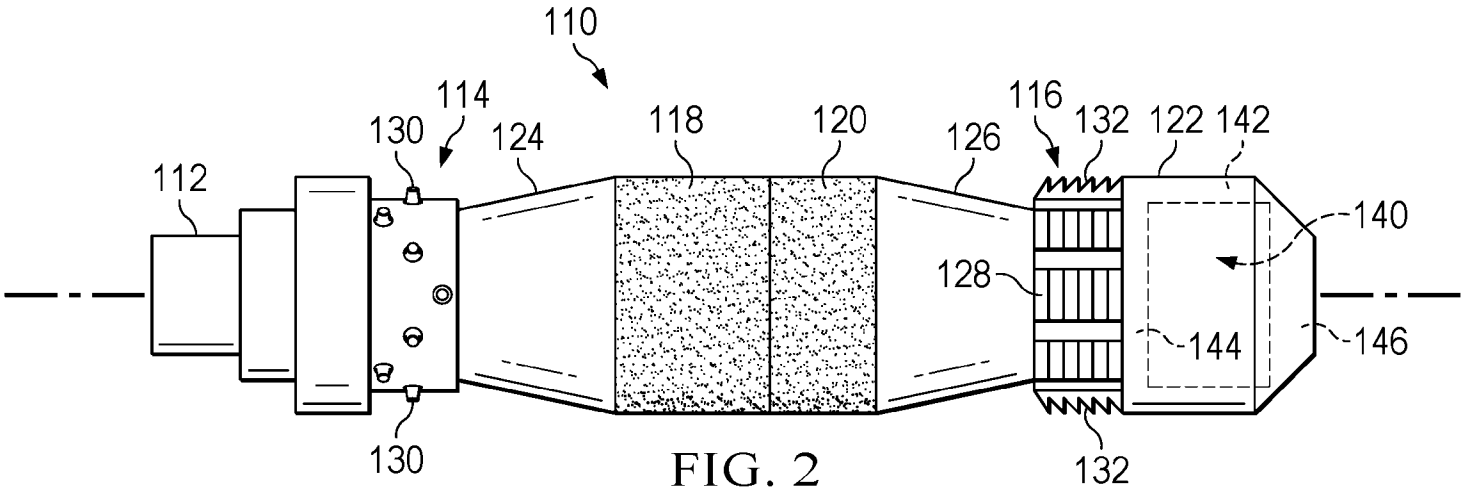
FIG. 2 is a side view depicting a bridge plug in accordance with one embodiment.

Embodiments are hereinafter described in detail in connection with the views and examples of FIGS. 2 and 3, wherein like numbers indicate the same or corresponding elements throughout the views. A bridge plug 110 is illustrated in FIG. 2 that is similar to, or the same in many respects as, the conventional bridge plug 10 illustrated in FIG. 1 except as otherwise described below. The bridge plug 110 can include a mandrel 112, an upper slip 114, a lower slip 116, and an upper sealing element 118 and a lower sealing element 120 disposed between the upper and lower slips 114, 116. A nosecone 122 can be disposed at a distal end of the lower slip 116.

The upper and lower slips 114, 116 can be configured to slide towards each other and along an upper slip ramp 124 and a lower slip ramp 126, respectively, to facilitate expansion of the upper and lower slips 114, 116 radially outwardly. The upper and lower slips 114, 116 can each include wedge shaped segments (e.g., 128) that can expand relative to, or even separate from, each other during radial expansion of the upper and lower slips 114, 116. The upper and lower slips 114, 116 can include teeth 130, 132 that are configured to embed into, or otherwise physically interface with, the wellbore to facilitate securement of the bridge plug 110 thereto. The upper and lower slips 114, 116 can additionally or alternatively include any of a variety of other suitable features that facilitate engagement with a wellbore, such as, for example, an outer surface impregnated with a hardened grit.

The upper and lower sealing elements 118, 120 can be configured to extend radially outwardly when they are axially compressed together. The upper and lower sealing elements 118, 120 can be formed of an elastomeric material, such as molded nitrile rubber, or any of a variety of other suitable additional or alternative materials that are flexible and configured to form an effective seal with a wellbore.

The bridge plug 110 can include a compression mechanism (not shown) that is configured to selectively apply axial compression to each of the upper and lower slips 114, 116 and the upper and lower sealing elements 118, 120 to cause radial expansion thereof. The compression mechanism can be a mechanical screw assembly, a hydraulically actuated piston, explosively set power springs, or any of a variety of other suitable devices or combinations thereof. When the bridge plug 110 is located in a wellbore, the compression mechanism, and thus the upper and lower slips 114, 116 and the upper and lower sealing elements 118, 120, can be remotely activated at the ground surface. A compressor actuator can be a mechanical actuator, a hydraulic actuator, or an electrical actuator depending on the type of compressor actuator that is being utilized (i.e., a mechanical screw assembly, a hydraulically actuated piston, or explosively set power springs, respectively).

The bridge plug 110, however, can include a fluid reservoir 140 that is configured to store a lubricating fluid onboard the bridge plug 110. The lubricating fluid contained in the fluid reservoir 140 can accordingly be delivered directly to a destination site together with the bridge plug 110 and can subsequently be stored at the destination site when the bridge plug 110 is set in place. During the fracking process, the lubricating fluid remain contained within the fluid reservoir 140. When the fracking process is complete, the removal tool can be introduced into the wellbore to bore out the bridge plug 110. The removal tool can bore through the bridge plug 110 which eventually reaches and ruptures the fluid reservoir 140 to cause the lubrication fluid contained therein to be dispensed to the surrounding area. The lubrication fluid can accordingly be targeted directly at the removal site to encourage more efficient removal of the bridge plug 110 than conventional methods as well as to dispense lubricating fluid downhole of the removal site to lubricate the removal tool as it progresses to the next removal site.

As illustrated in FIG. 2, the fluid reservoir 140 is shown to be formed in the nosecone 122. The nosecone 122 can include a sidewall 142, a bottom wall 144, and a tip portion 146 that cooperate to define the fluid reservoir 140. The lubricating fluid and the fluid reservoir 140 can be fully encapsulated within the nosecone 122 by the sidewall 142, the bottom wall 144, and the tip portion 146 such that the lubricating fluid is fluidically isolated from, and thus impervious to, the surrounding environment. As such, when the bridge plug 110 is delivered to a desired location and set in place, the lubricating fluid not contaminated, diluted or otherwise adversely impacted by the surrounding environment of the wellbore. As a result, the lubricating fluid distributed from the fluid reservoir 140 can be targeted at the destination site which can result in a purer and more highly concentrated lubricant that can be delivered in a smaller volume than conventional lubricants that are typically delivered to a bridge plug 110 by flooding the wellbore.

The nosecone 122 can be positioned at a distal end of the bridge plug 110 such that the nosecone 122 is pointed downhole when the bridge plug 110 is deployed into the wellbore. When the removal tool bores through the bridge plug 110, the fluid reservoir 140 is able to be ruptured closer to the end of the bridge plug 110 where the boring process is most prone to significant resistance and failure. As such, the lubricating fluid is able to lubricate the removal tool and the surrounding area at a critical point in the boring process to reduce the resistance and likelihood of failure that might otherwise occur. In addition, by providing the fluid reservoir 140 near the end of the bridge plug 110, residual lubricating fluid is able to be introduced downhole of the bridge plug 110 which can facilitate lubrication of the removal tool as it progresses towards a further downstream bridge plug. The fluid reservoir 140 can accordingly provide a self-contained capsule of lubricating fluid on the bridge plug 110 that is rigid enough to maintain its integrity during delivery and setting of the bridge plug 110 yet pliable enough to be ruptured during the removal process to allow for the lubricating fluid to dispensed to the wellbore. The lubrication fluid can accordingly be distributed directly to a destination site, via the bridge plug 110, in a more concentrated form than would otherwise be available with conventional lubricating methods which can accordingly enhance the effectiveness and performance of the removal process. It is to be appreciated that, although the fluid reservoir 140 is described as being a fully self-contained capsule, an alternative configuration is contemplated where the fluid reservoir 140 may include at least one perforation that of allows a small volume of the lubricating fluid to be released to the wellbore during installation to lubricate the walls of the wellbore.

In one embodiment, the tip portion 146 can be releasably coupled with the sidewall 142 such that the tip portion 146 serves as a removable lid that allows for filling of the fluid reservoir 140 with the lubricating fluid and subsequent sealing thereof. In such an embodiment, during manufacturing of the bridge plug 110, the tip portion 146 can be opened relative to the sidewall 142 to allow for the fluid reservoir 140 to be filled with lubrication fluid. Once the fluid reservoir 140 is sufficiently filled, the tip portion 146 can be secured onto the sidewall 142 to effectively seal the fluid reservoir 140 (e.g., via welding, bonding, or threaded engagement). In some embodiments, the nosecone 122 can be formed as a unitary one-piece construction that can be filled with lubrication fluid via a fill port or during the manufacturing process where the nosecone 122 is constructed over the fluid reservoir 140 that has already been filled with the lubrication fluid.

It is to be appreciated that although the fluid reservoir 140 is described as being included in a nosecone, a fluid reservoir can be integrated into a bridge plug at any of a variety of suitable alternative locations. For example, when a bridge plug is configured with a hollow mandrel (e.g., that includes a passageway that extends entirely through the bridge plug), the fluid reservoir can be incorporated as part of the mandrel and disposed circumferentially about the passageway. It is also to be appreciated that although a bridge plug is described herein, any of a variety of suitable alternative downhole tools are contemplated that can incorporate an onboard fluid reservoir, such as, for example, a ball drop tool, a ball check plug, a cement retainer, and a packer. It is further to be appreciated that although a lubricant fluid is described herein, any of a variety of suitable alternative fluids are contemplated for use in an onboard fluid reservoir, such as, for example, viscosifying agents, lost circulation materials, fluid loss additives, surfactants, polyacrylamide friction reducers, polymer breaker additives, catalysts, corrosion inhibitors, iron control agents, iron reducing agents, anti-sludging compounds, non-emulsifying products, biocides, scale inhibitors, clay control agents, foamers, and de-foamers.

The construction, deployment, and extraction of the bridge plug 110 will now be described. First, the bridge plug 110 can be constructed with the fluid reservoir 140 integrally formed therein (e.g., in the nosecone 122 or at another location on the bridge plug 110). A lubricating fluid can be contained in the fluid reservoir 140 such that the lubricating fluid is fully encapsulated in the bridge plug 110. The bridge plug 110 can then be attached to a tubular and deployed into a wellbore to deliver the bridge plug 110 and the encapsulated lubricating fluid to a desired location. A compression mechanism within the bridge plug 110 can then be activated to cause a slip (e.g., 114, 116) and a sealing element (e.g., 118, 120) to extend radially outwardly and into engagement with the wellbore thereby setting the bridge plug 110 with respect to the wellbore. The tubular can then be disconnected from the bridge plug 110 and withdrawn from the wellbore. The area above the bridge plug 110 can then be fracked. Once the fracking process is completed, a removal tool can be introduced into the wellbore (e.g., via the tubular) to bore out the bridge plug 110. During boring out of the bridge plug 110, the removal tool can rupture the fluid reservoir 140 which can cause the lubricating fluid to be introduced to the surrounding environment to lubricate the surrounding environment as well as the area downhole from the bridge plug 110. Once the bridge plug 110 has been removed, the removal tool can proceed further down the wellbore to remove any additional bridge plugs in a similar manner until all of the bridge plugs have been removed from a wellbore.

Figure 3:
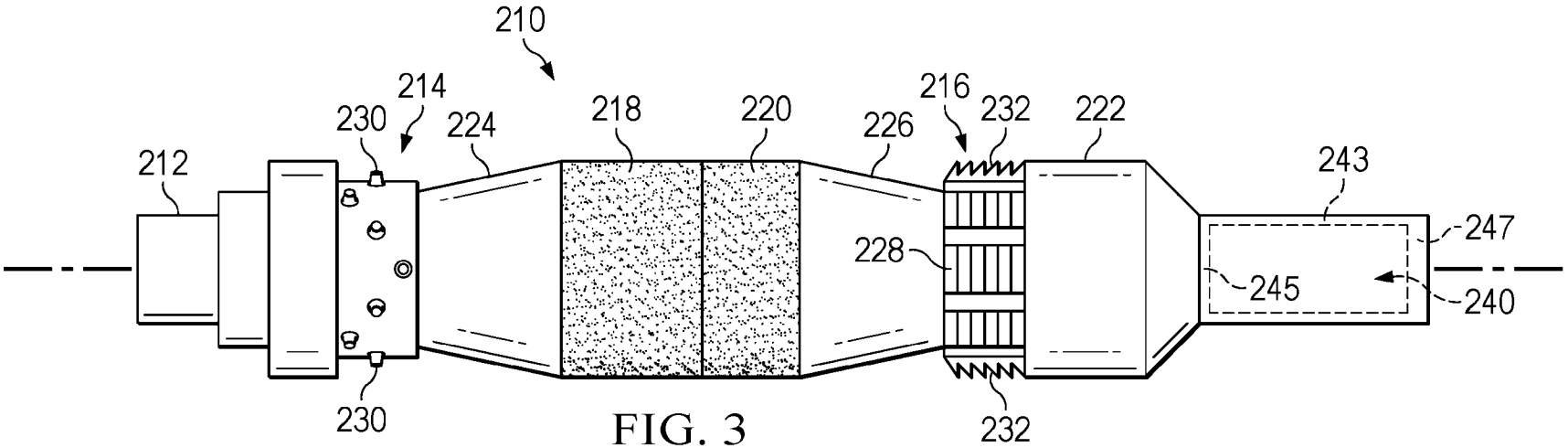
FIG. 3 is a side view depicting a bridge plug in accordance with another embodiment.

A bridge plug 210 is illustrated in FIG. 3 that is similar to, or the same in many respects as, the bridge plug 110 illustrated in FIG. 2 except as otherwise described below. The bridge plug 210 can include a mandrel 212, an upper slip 214, a lower slip 216, an upper sealing element 218 and a lower sealing element 220 disposed between the upper and lower slips 214, 216. A nosecone 222 can be disposed at a distal end of the lower slip 216.

The upper and lower slips 214, 216 can be configured to slide towards each other and along an upper slip ramp 224 and a lower slip ramp 226, respectively, to facilitate expansion of the upper and lower slips 214, 216 radially outwardly. The upper and lower slips 214, 216 can each include wedge shaped segments (e.g., 228) that can expand relative to, or even separate from, each other during radial expansion of the upper and lower slips 214, 216. The upper and lower slips 214, 216 can include teeth 230, 232 that are configured to embed into, or otherwise physically interface with, the wellbore to facilitate securement of the bridge plug 210 thereto. The upper and lower slips 214, 216 can additionally or alternatively include any of a variety of other suitable features that facilitate engagement with a wellbore, such as, for example, an outer surface impregnated with a hardened grit.

The upper and lower sealing elements 218, 220 can be configured to extend radially outwardly when they are axially compressed together. The upper and lower sealing elements 218, 220 can be formed of an elastomeric material, such as molded nitrile rubber, or any of a variety of other suitable additional or alternative materials that are flexible and configured to form an effective seal with a wellbore.

The bridge plug 210 can include a compression mechanism (not shown) that is configured to selectively apply axial compression to each of the upper and lower slips 214, 216 and the upper and lower sealing elements 218, 220 to cause radial expansion thereof. The compression mechanism can be a mechanical screw assembly, a hydraulically actuated piston, explosively set power springs, or any of a variety of other suitable devices or combinations thereof. When the bridge plug 210 is located in a wellbore, the compression mechanism, and thus the upper and lower slips 214, 216 and the upper and lower sealing elements 218, 220, can be remotely activated at the ground surface. The compressor actuator can be a mechanical actuator, a hydraulic actuator, or an electrical actuator depending on the type of compressor actuator that is being utilized (i.e., a mechanical screw assembly, a hydraulically actuated piston, or explosively set power springs, respectively).

A fluid reservoir 240 can be provided that is separate from and releasably attached to the bridge plug 210. In one embodiment, the fluid reservoir 240 can be threaded onto a distal end of the nosecone 222 such that the fluid reservoir 240 extends distally from the nosecone 222. However, it is to be appreciated that the fluid reservoir 240 can be attached to the rest of the bridge plug 210 with any of a variety of suitable alternative attachment arrangements, such as, for example, with adhesive, and at any of a variety of suitable locations, such as, for example, at the mandrel.

The fluid reservoir 240 can include a sidewall 243, a bottom wall 245, and a tip portion 247 that cooperate to define the fluid reservoir 240. When the lubricating fluid is contained in the fluid reservoir 240, the sidewall 243, the bottom wall 245, and the tip portion 247 can cooperate to fully encapsulate the lubricating fluid within the fluid reservoir 240 such that the fluid reservoir 240 and the lubricating fluid are fluidically isolated from the surrounding environment. As such, when the bridge plug 210 is delivered to a desired location, the lubricating fluid is able to be delivered to the destination site as part of the bridge plug 210 and is thus stored at the destination site until it is subsequently released via the removal process.

In one embodiment, the tip portion 247 can be releasably coupled with the sidewall 243 such that the tip portion 247 serves as a removable lid that allows for filling of the fluid reservoir 240 with the lubricating fluid and subsequent sealing thereof. In such an embodiment, during manufacturing of the bridge plug 210, the tip portion 247 can be opened relative to the sidewall 243 to allow for the fluid reservoir 240 to be filled with lubrication fluid. Once the fluid reservoir 240 is sufficiently filled, the tip portion 247 can be secured onto the sidewall 243 (e.g., via welding, bonding, or threaded engagement) to effectively seal the fluid reservoir 240. In some embodiments, the fluid reservoir 240 can be formed as a unitary one-piece construction that can be filled with lubrication fluid via a fill port or even simultaneously during the manufacturing process of the fluid reservoir 240.

The assembly, installation, and removal of the bridge plug 210 will now be described. First, the bridge plug 210 and the fluid reservoir 240 are constructed separate from each other with the fluid reservoir 240 being filled with a lubricating fluid. The fluid reservoir 240 is then attached to the bridge plug 210 which is attached to a tubular and deployed into a wellbore to a desired location. A compression mechanism within the bridge plug 210 is then activated to cause a slip (e.g., 214, 216) and a sealing element (e.g., 218, 220) to extend radially outwardly and into engagement with the wellbore thereby setting the bridge plug 210 with respect to the wellbore. The tubular is then disconnected from the bridge plug 210 and withdrawn from the wellbore. Fracking can then be commenced at the area above the bridge plug 210. Once the fracking is completed, a removal tool can be routed through the wellbore and to the bridge plug 210 to remove the bridge plug 210. During boring out of the bridge plug 210, the removal tool eventually ruptures the fluid reservoir 240 which causes the lubricating fluid to be released to the surrounding environment. This removal process can then be repeated until all of the bridge plugs 210 are removed from a wellbore.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather, it is hereby intended that the scope be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A downhole tool for hydraulic fracturing or other downhole wellbore work, the downhole tool comprising:
- a mandrel;
- a slip configured to selectively extend radially outwardly from the mandrel to facilitate engagement with a wellbore for setting of the downhole tool thereto;
- a sealing element configured to selectively extend radially outwardly from the mandrel to facilitate engagement with a wellbore for creating a seal therebetween;
- a fluid reservoir configured to store a fluid onboard the downhole tool; and
- a nosecone, wherein the fluid reservoir is formed in the nosecone.

2. The downhole tool of claim 1, further comprising a slip ramp that interfaces with the slip to facilitate extension of the slip radially outwardly from the mandrel.

3. The downhole tool of claim 2, wherein the slip further comprises teeth that are configured to embed into a wellbore.

4. The downhole tool of claim 1, further comprising a compression mechanism configured to selectively apply axial compression to the slip to cause radial expansion thereof.

5. The downhole tool of claim 1 wherein the downhole tool comprises a bridge plug.

6. A downhole tool for hydraulic fracturing or other downhole wellbore work, the downhole tool comprising:
- a mandrel;
- a slip configured to selectively extend radially outwardly from the mandrel to facilitate engagement with a wellbore for setting of the downhole tool thereto;
- a sealing element configured to selectively extend radially outwardly from the mandrel to facilitate engagement with a wellbore for creating a seal therebetween;
- a fluid reservoir configured to store a fluid onboard the downhole tool; and
- a nosecone, wherein the fluid reservoir is releasably attached to the nosecone.

7. The downhole tool of claim 6, further comprising a slip ramp that interfaces with the slip to facilitate extension of the slip radially outwardly from the mandrel.

8. The downhole tool of claim 7, wherein the slip further comprises teeth that are configured to embed into a wellbore.

9. The downhole tool of claim 6, further comprising a compression mechanism configured to selectively apply axial compression to the slip to cause radial expansion thereof.

10. The downhole tool of claim 6 wherein the downhole tool comprises a bridge plug.

11. A downhole tool for hydraulic fracturing or other downhole wellbore work, the downhole tool comprising:
- a mandrel;
- a slip configured to selectively extend radially outwardly from the mandrel to facilitate engagement with a wellbore for setting of the downhole tool thereto;
- a sealing element configured to selectively extend radially outwardly from the mandrel to facilitate engagement with a wellbore for creating a seal therebetween;
- a fluid reservoir onboard the downhole tool;
- a fluid disposed in the fluid reservoir; and
- a nosecone, wherein the fluid reservoir is disposed in the nosecone.

12. The downhole tool of claim 11, further comprising a slip ramp that interfaces with the slip to facilitate extension of the slip radially outwardly from the mandrel.

13. The downhole tool of claim 12, wherein the slip further comprises teeth that are configured to embed into a wellbore.

14. The downhole tool of claim 11, further comprising a compression mechanism configured to selectively apply axial compression to the slip to cause radial expansion thereof.

15. The downhole tool of claim 11, wherein the fluid reservoir is releasably attached to the nosecone.

16. The downhole tool of claim 11 wherein the downhole tool comprises a bridge plug.

17. The downhole tool of claim 11 wherein the fluid comprises a lubricating fluid.

18. A method for lubricating a wellbore with a downhole tool, the method comprising:
- forming a downhole tool with a fluid reservoir that is onboard the downhole tool;
- filling the fluid reservoir with a fluid;
- positioning the downhole tool within a wellbore;
- setting the downhole tool within the wellbore;
- removing, by a removal tool, the downhole tool from the wellbore; and
- during removal of the downhole tool, rupturing, by the removal tool, the fluid reservoir to cause dispensation of the fluid from the fluid reservoir to the wellbore.

19. The method of claim 18, wherein the fluid reservoir is releasably attached to the downhole tool.

20. The method of claim 18 wherein the downhole tool comprises a bridge plug.

* * * * *